United States Patent [19]

Lapsker

[11] Patent Number: 4,971,362

[45] Date of Patent: Nov. 20, 1990

[54] PRESCRIPTION PAD

[75] Inventor: Joshua Lapsker, Thornhill, Canada

[73] Assignee: Promo-Ad Canada Ltd., Concord, Canada

[21] Appl. No.: 460,025

[22] Filed: Jan. 2, 1990

[51] Int. Cl.[5] ..... B42D 15/00

[52] U.S. Cl. ..... 283/58; 283/62; 283/117; 283/900

[58] Field of Search ..... 283/56, 58, 62, 900, 283/31, 117

[56] References Cited

U.S. PATENT DOCUMENTS

| | | | |
|---|---|---|---|
| 425,496 | 4/1890 | Denzel . | |
| 730,083 | 6/1903 | Beach . | |
| 1,186,047 | 6/1916 | Sigsbee . | |
| 1,343,110 | 6/1920 | Camp | 283/58 |
| 1,564,296 | 12/1925 | Tiefel | 283/58 |
| 1,613,881 | 1/1927 | Garvin . | |
| 3,625,547 | 12/1971 | Burke . | |
| 4,405,157 | 9/1983 | Bennett . | |
| 4,807,909 | 2/1989 | Lapsker . | |

FOREIGN PATENT DOCUMENTS

| | | | |
|---|---|---|---|
| 2834675 | 2/1980 | Fed. Rep. of Germany | 283/62 |

OTHER PUBLICATIONS

"Super Saving Bonus Check", Jun., 1965.

"Tiger Buck", Jun., 1966.

*Primary Examiner*—Paul A. Bell
*Assistant Examiner*—Hwei-Siu Payer
*Attorney, Agent, or Firm*—Bachman & LaPointe

[57] ABSTRACT

A prescription pad comprises a plurality of units each comprising an associated preprinted prescription leaf and preprinted check leaf; the preprinted prescription leaf bears a preprinted prescription for a distinct pharmaceutical product as well as a zone for entry of patient information and a zone for entry of the signature of the prescribing physician; the check leaf bears on one face a preprinted check in favor of a dispensing pharmacist, and has a value based on the value of the prescribed product and a dispensing fee, and has an endorsing zone preprinted with a dispensing acknowledgement legend relating to the preprinted prescription with an entry portion for entry of the endorsing signature of the dispensing pharmacist; the check leaf is preferably coded to identify the physican. The pad can be employed for the prescribing of free starter dosages of the pharmaceutical product for the patient or to provide the patient with a discount; the pharmacist is reimbursed simply by depositing the endorsed preprinted check in his bank account, and the control body on whose account the check is drawn is able to monitor the use of the preprinted prescriptions by physicians and provide the pharmaceutical company with valuable information.

26 Claims, 5 Drawing Sheets

Fig. 1
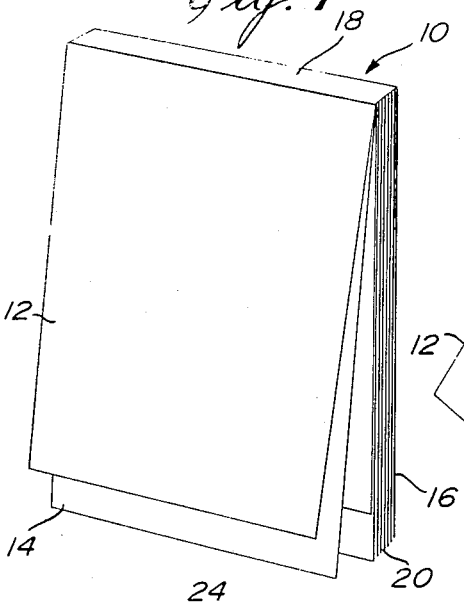
Fig. 2
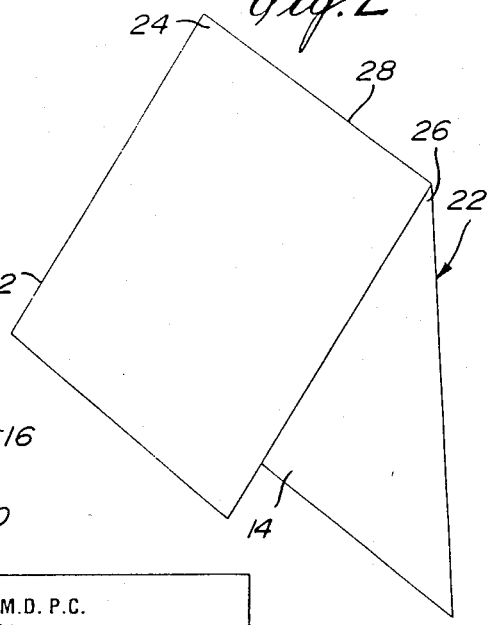
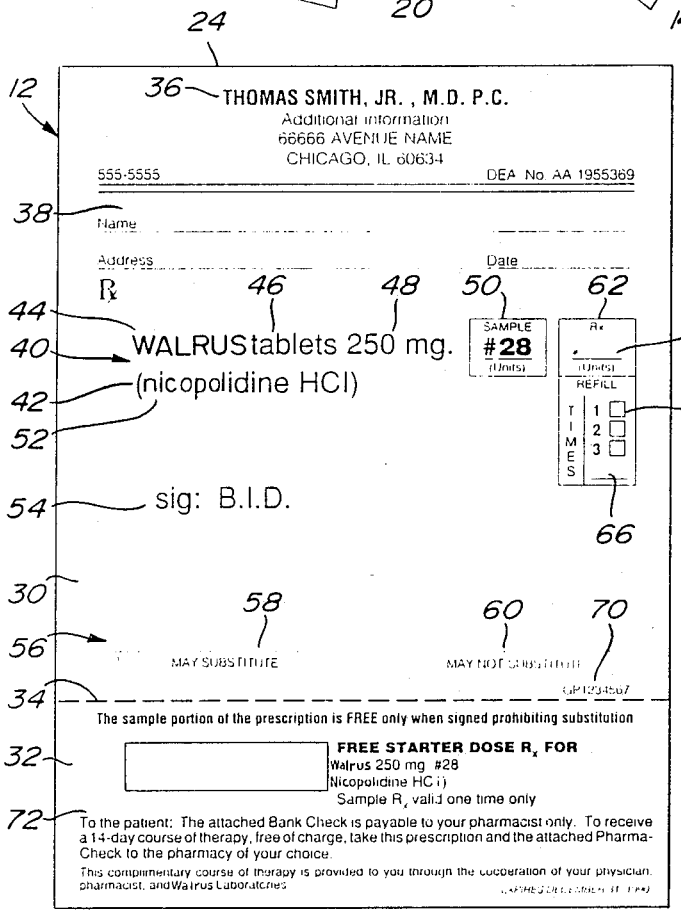
Fig. 3

PRESCRIPTION PAD

BACKGROUND OF THE INVENTION (i) Field of the Invention

This invention relates to a prescription pad, as well as to a system of monitoring and controlling the dispensing of samples of prescription pharmaceuticals and the dispensing of prescription pharmaceuticals at a discount to the patient.

(ii) Description of Prior Art

Certain pharmaceuticals are only available for purchase with a written prescription from a physician. In such case, the physician writes out a prescription, sometimes known as an Rx, for an appropriate pharmaceutical for the patient, the patient takes the prescription to a pharmacist who dispenses the pharmaceutical in accordance with the prescription and obtains payment from the patient.

In the marketing and promotion of pharmaceuticals it is a common practice for pharmaceutical corporations to provide physicians with sample packages of their pharmaceutical products. The physicians then provide their patients with such samples free of charge, whereby a determination can be made by the physician as to whether or not the pharmaceutical is suitable for the needs of the individual patient, without the patient incurring the expense of purchasing the product. At the same time the physician develops goodwill with the patient since the patient is not faced with purchasing a product which may prove unsatisfactory for his particular needs.

The practice is advantageous for the pharmaceutical company since the physician is more likely to prescribe a pharmaceutical which he has been able to determine is satisfactory for the particular need of his patient, by an initial free sample.

The benefits are such that the practice of providing free samples is wide spread. There are, however, a number of disadvantages in the existing practice.

For the pharmaceutical company there are the disadvantages associated with the expense of producing and distributing small sample packages, the expense of which is incurred whether or not the physician actually uses them. The pharmaceutical company has no control over the manner in which the physician uses the samples, for example, a physician might provide a patient with a sufficient amount of free samples so that the patient's needs are fully met without purchasing product, or perhaps with expired product which is no longer effective.

The number and geographical distribution of physicians makes it almost impossible to provide all physicians with a supply of samples and ensure that supplies are replenished as needed.

Previously there was no ready means for the pharmaceutical company to determine if its program of free samples is effective in producing sales.

For the physician there are the disadvantages associated with the need to safely store a wide variety of free samples while keeping them readily accessible for patients. In addition the physician has some responsibility to ensure that he does not maintain expired product. These factors present additional time consuming administration problems for busy physicians.

My earlier U.S. Pat. No. 4,807,909 issued Feb. 28, 1989, provides a solution to these problems, and enables the pharmaceutical company to efficiently and safely use samples in the marketing of their product.

A disadvantage of the system of U.S. Pat. No. 4,807,909 is that the pharmacist is required to submit the control stub 108 to the control body for reimbursement. If the pharmacist has only a small number of such control stubs for redemption he is either forced with additional paper work to recover a small amount of money, or he retains the stubs for an unduly long time before submitting them for reimbursement. This is disadvantageous to the pharmacist from the standpoint of cash flow and distorts the statistics and information developed by the control body and hence is disadvantageous to the pharmaceutical company.

Another prior aspect of promotion of prescription pharmaceuticals relates to the use of discount vouchers or coupons which are distributed to medical practitioners by pharmaceutical representatives. Periodically pharmaceutical companies develop programs of limited duration involving such discount vouchers or coupons. In the existing practice such vouchers or coupons are distributed to the patient by the medical practitioner at the time of writing the prescription.

In practice a busy practitioner may forget to give a patient a discount voucher, or overlook that he has them at all, especially if he is receiving many different discount vouchers from different pharmaceutical companies. Such discount vouchers, which usually are only usable for a limited duration, also utilize storage space in the practitioner's office and at the same time need to be readily accessible.

Under the current practice, the pharmacist redeeming the discount voucher faces the problem that he must submit the voucher to a separate control body to obtain reimbursement, and if he has only a small number of vouchers for redemption, each of low value, he may view the practice as inconvenient and decline to participate in the program. This is inconvenient for the patient and may also reflect unfavourably on the pharmaceutical company and their product.

Furthermore, although under such practice, the pharmaceutical company can obtain an indication of the extent of use of the vouchers, since it will know the number submitted for reimbursement, it has no ready means of determining which medical practitioners actually use the vouchers, or the extent of use by individual practitioners.

It is an object of the present invention to overcome the disadvantages associated with these previous practices.

It is an object of the invention to provide a prescription pad whereby the dispensing of free sample starter dosages and products with discount vouchers can be monitored and controlled.

It is a further object of the invention to provide a prescription pad whereby the pharmaceutical companies may employ programs for sample starter dosages and discount vouchers with greater efficiency.

It is a further object of the invention to provide a prescription pad assembly and a binder assembly incorporating the prescription pad assembly.

It is a still further object of this invention to provide a prescription pad whereby the pharmacist is more readily reimbursed for dispensing sample dosages for which the patient does not pay and for participation in discount programs.

SUMMARY OF THE INVENTION

In accordance with the invention a prescription pad includes at least first and second associated sheet means, and more especially a plurality of first and second sheet members with each first sheet member being associated with a second sheet member.

The first sheet member has a prescription portion including a first zone bearing a preprinted prescription for a distinct pharmaceutical product, a second zone for entry of information identifying a patient for whom the pharmaceutical product is being prescribed and a third zone for entry of the signature of the prescribing medical practitioner.

The second sheet member bears a preprinted cheque on a first face, the preprinted cheque being drawn in favour of a pharmacist; the cheque has a monetary value to such pharmacist which encompasses a value attributable to the pharmaceutical product being prescribed and a pharmacy dispensing fee, or represents a discount of the cost to the patient of the preprinted prescription.

The second sheet member has an endorsing zone preprinted with a dispensing acknowledgement legend related to the preprinted prescription; the endorsing zone has an entry portion for entry of the endorsing signature of the dispensing pharmacist.

In particular at least the second sheet members are coded to identify the physician or other medical practitioner.

In this way the pharmacist is able to obtain reimbursement by depositing the preprinted cheque at the bank at which he conducts his usual business. The control body which holds the bank account on which the preprinted cheque is drawn, receives the cancelled cheque and is able to identify the medical practioner who made the prescription, by reference to the identification code on the cheque. The control body can then develop statistics and information as to the medical practitioners prescribing the pharmaceutical product for use by the pharmaceutical company.

In another embodiment of the invention there is provided a prescription pad assembly incorporating the prescription pad as a component.

In still another embodiment of the invention there is provided a binder assembly incorporating the prescription pad assembly.

BRIEF DESCRIPTION WITH REFERENCE TO THE DRAWINGS

FIG. 1 is a schematic representation of a prescription pad of the invention;

FIG. 2 is a schematic representation of a unit of the pad of FIG. 1;

FIG. 3 is a front view of a prescription leaf of the unit of FIG. 2;

DESCRIPTION OF PREFERRED EMBODIMENTS WITH REFERENCE TO THE DRAWINGS

Figure 4:
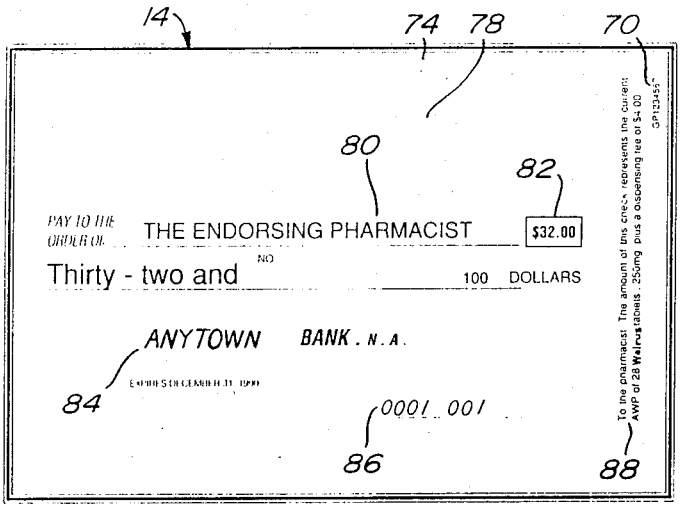
FIG. 4 is a front view of a cheque leaf of a unit of FIG. 2.

With further reference to FIG. 1, a prescription pad assembly 10 includes a plurality of prescription leaves 12 and cheques leaves 14 and a support card 16.

An adhesive hinge strip 18 hingedly supports the leaves 12 and 14 on the support card 16. The leaves 12 and 14 in the assembly 10 form a stack 20 composed of units 22.

With further reference to FIG. 2 each unit 22 comprises a single prescription leaf 12 and a single cheque leaf 14 adhesively hinged together by an adhesive hinge 28 at opposed adjacent edges 24 and 26, respectively, of prescription leaf 12 and cheque leaf 14.

With further reference to FIG. 3, prescription leaf 12 comprises a printed prescription form 30 and a printed stub 32 separated by a tearable separation line 34.

Printed prescription form 30 includes a medical practitioner data zone 36, a patient identification zone 38, a preprinted prescription 40, and a signing zone 56.

The zone 36 typically includes the name, address and telephone number of the medical practitioner, for example, a physician, whereby the prescription forms are personalized for use by such physician.

The zone 38 comprises the legends NAME and ADDRESS with a space for the physician to enter the name and address of the patient for whom the prescription is intended.

The preprinted prescription 40 includes preprinted data 42 including the brand name 44, the dosage form 46, the unit dosage 48, the quantity prescribed 50, expressed in terms of the number of unit dosages 48, the chemical name 52 of the active ingredient, and information 54 as to the frequency with which the dosage 48 is to be taken.

Thus the data 42 of preprinted prescription 40 provides a dispensing pharmacist with all the information required to dispense the pharmaceutical product of brand name 44 and chemical name 52.

The signing zone 56 is provided for the physician to enter his signature confirming the prescribing of the preprinted prescription 40 in favour of the patient identified by the physician in patient identification zone 38.

The signing zone 56 includes direction entry portions 58 and 60 bearing the legends MAY SUBSTITUTE and MAY NOT SUBSTITUTE, respectively, and the prescribing physician places his signature adjacent the appropriate legend as a direction to the dispensing pharmacist.

Printed prescription form 30 further includes a preprinted refill zone 62 having labelled boxes 64 and a refill number line 66, as well as a refill quantity line 68. In this way the prescribing physician may indicate to the dispensing pharmacist whether or not the prescription may be repeated, and the number of times that it may be repeated by selection of a preprinted number associated with a box 64 or entry by the physician of a refill number in refill number line 66. Likewise the physician may enter the refill quantity line 68 the number of units to be included in any refills.

Finally the printed prescription form 30 includes a medical practitioner identification code 70 which is a code by means of which a control body identifies the medical practitioner identified in zone 36 of the printed prescription form 30.

The printed stub 32 contains an information zone 72 with preprinted information for the patient relating to the preprinted prescription 40 of form 30, and the manner in which the prescription may be dispensed.

Figure 5:
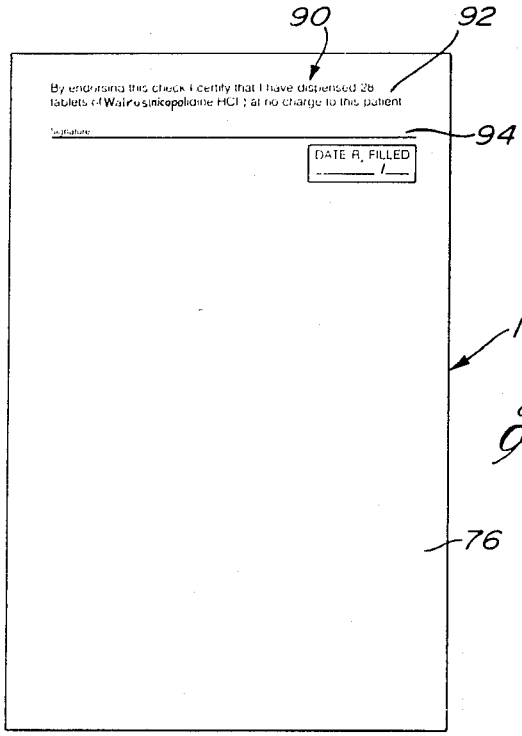
FIG. 5 is a rear view of a cheque leaf of a unit of FIG. 2.

With further reference to FIGS. 4 and 5 a cheque leaf 14 comprises a front face 74 more particularly shown in FIG. 4 and a rear face 76 more particularly shown in FIG. 5.

With further reference to FIG. 4, the front face 74 of cheque leaf 14 bears a preprinted cheque 78 made out to a payee 80 more especially THE ENDORSING PHARMACIST for a monetory value 82 completed in figures and words.

The preprinted cheque 78 further includes a legend 84 identifying the Bank on which the cheque 78 is drawn, an Account No. zone 86 and a Notice to Pharmacist zone 88.

The preprinted cheque 78 further includes the medical practitioner identification code 70 of prescription leaf 12.

The rear face 76 has an endorsing zone 90 with a preprinted legend 92 and an entry portion 94 for entry of the pharmacist's signature. The preprinted legend 92 contains an acknowledgement by the pharmacist that he has dispensed the pharmaceutical product of the preprinted prescription 40.

The face 76 and the form 30 additionally have entry zones for insertion of the date of the prescription and date of dispensing, respectively.

In a particular embodiment the prescription pad assembly comprises a plurality of identical prescription leaves 12 and cheque leaves 14 and the preprinted prescription is for a sample or free starter dose of a definite pharmaceutical product.

In such case at least a portion of the data 42 of preprinted prescription 40 appears in the information zone 72 of printed stub 32 in the Notice to Pharmacist 88, on front face 74 of cheque leaf 14 and in the preprinted legend 92 on the rear face 76 of cheque leaf 14.

In use the physician identified in zone 36 wishing to prescribe the distinct pharmaceutical product of brand name 44 in a starter dose, completes zone 38 to identify the name and address of the patient and additionally inserts the date of the prescription. The physician completes signing zone 56 in the appropriate entry portion 58 and 60, and in particular signs at entry portion 60 to indicate that the dispensing pharmacist may not substitute another product for the brand name 44 of preprinted prescription 40.

In his judgement the physician may also complete preprinted refill zone 62 to permit subsequent refills without further prescription, identifying both the number of times which the prescription may be refilled and the number of units of the refills.

Thereafter the physician removes from assembly 10 a unit 22 comprising the prescription leaf 12 which he has completed with the associated cheque leaf 14.

In this regard individual units 22 are readily removable from the stack 20 without disturbing the remaining units, and without separation of the leaves 12 and 14 of such removed unit 22.

In order to facilitate removal of an integral unit 22 without separation of the leaves 12 and 14 of such unit 22, it is found advantageous to have cheque leaf 14 extend or project beyond prescription leaf 12 remote from adhesive hinge strip 18. In this way an uppermost unit 22 is more readily hingedly lifted away from the stack 20 about adhesive hinge strip 18 and such unit 22 may be readily grasped between the thumb and forefinger and drawn away from the assembly 10 without disturbing the adhesive hinge 28 of such unit 22.

In this way the physician presents to the patient an integral unit 22 in which the prescription leaf 12 and cheque leaf 14 remain attached together.

Following the instruction in the information zone 72 of printed stub 32 the patient presents the unit 22 to a pharmacist of his choice. The pharmacist notes the information in the notice 88 of front face 74, separates cheque leaf 14 from prescription leaf 12, endorses the rear face 76 of cheque leaf 14 in entry portion 94 acknowledging the dispensing of the definite pharmaceutical product according to preprinted prescription 40, enters the date of acknowledgement and submits the preprinted cheque 78 to his bank for payment. The pharmacist in dispensing the definite pharmaceutical product in accordance with the preprinted prescription 40 may remove printed stub 32 of prescription leaf 12 and return it to the patient, if the patient has not already removed it. Thereafter the pharmacist retains the printed prescription form 30 in his records as a record of his dispensing of the preprinted prescription 40, and for future reference in the event that the physician has completed the preprinted refill zone 62.

The preprinted cheque 78 is drawn on the account of a control body and the pharmacist is reimbursed for the dispensing by the monetary value 82 identified on the front face 74 of the preprinted cheque 78. In the particular case in which the preprinted prescription 40 is for a free sample dosage, the pharmacist is fully reimbursed for the dispensing of the definite pharmaceutical product by the control body without payment from the patient. In this case the notice 88 on the cheque advises the pharmacist that the monetary value 82 is for the dispensing of the definite pharmaceutical product identified by reference to at least some of the data 42 on preprinted prescription 40, based on the average wholesale price of the prescribed product together with a defined dispensing fee.

The control body which reimburses the pharmacist is able to identify the definite pharmaceutical product and the amount dispensed by means of the notice 88 on the preprinted cheque 78, as well as by the preprinted legend 92, and is able to identify the physician who prescribed the definite pharmaceutical product by means of the medical practitioner identification code 70 which appears on the preprinted cheque 78.

The control body is thus able to assemble information as to the prescribing practice of particular medical practitioners including the total amount that they have prescribed.

Periodically the control body submits particulars to the manufacturer of the definite pharmaceutical product and recovers its expenses incurred with respect to the monetary value of the preprinted cheques deposited by the pharmacists, and additionally obtains compensation for the information supplied to the pharmaceutical manufacturer as to the quantities prescribed by particular medical practitioners. The pharmaceutical manufacturer is thus able to more readily identify those medical practitioners who are prescribing their pharmaceutical product and the frequency of prescribing.

In this way the pharmaceutical manufacturer can avoid the problems associated with providing physicians with sample packages of their pharmaceutical products for distribution among patients, the physician avoids the need to store samples and monitor an inventory of samples, the pharmaceutical manufacturer avoids the waste associated with providing physicians with samples which they do not employ, or the problems encountered with physicians having samples in their possession which have passed the expiry date beyond which they are preferably not administered, the pharmacist obtains reimbursement more easily and with less paper work, and the control board is able to compile accurate information.

The prescription pad assembly 10, is not restricted to use in conjunction with free starter or dosage prescriptions but can likewise be employed to provide a discount. In such case the monetary value 82 of the preprinted cheque 78 will not be for the full value of the preprinted prescription 40 but will represent an amount which the pharmacist will deduct from the full amount payable. In this way the pharmacist receives payment from the patient in the amount of the full value minus the monetary value 82 on the preprinted cheque 78, and is reimbursed the latter by the control body, by depositing the preprinted cheque 78 at his bank. In this way too the control body is able to assemble data as to the prescribing practice of medical practitioners and is thereby able to identify medical practitioners who are prescribing the product as well as medical practitioners who are not, thereby permitting more efficient use of pharmacuetical representatives and sales staff.

A plurality of prescription pad assemblies 10, each for different definite pharmaceutical products may be employed in place of the pads (more especially pads 92, 94, 96, 98, 100 and 102) in the assembly described in my earlier U.S. Pat. No. 4,807,909 issued Feb. 28, 1989, the disclosure of which is incorporated herein by reference.

The prescription pad assembly 10 of the present invention has the advantages of the pads of the earlier U.S. Pat. No. 4,807,909 but provides for more ready reimbursement to the dispensing pharmacist since the preprinted cheque 78 may be deposited directly by the pharmacist in his own bank without the necessity of collecting and submitting them to the control body for reimbursement.

Figures 6, 7:
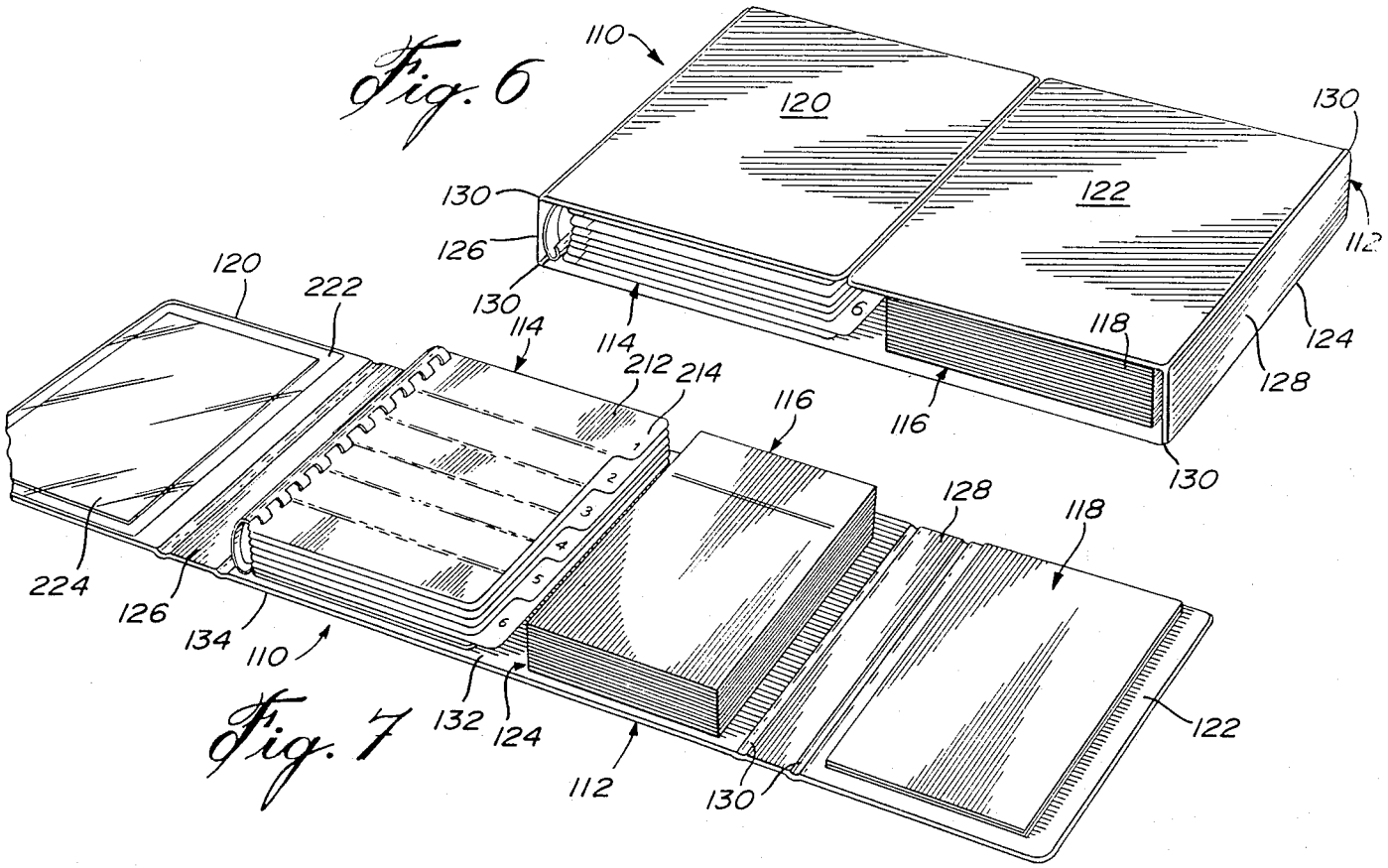
FIG. 6 is a perspective view of a binder assembly in accordance with the invention in a closed configuration.
FIG. 7 is a perspective view of the binder assembly of FIG. 6 in an open configuration.

With further reference to FIGS. 6 and 7, a binder assembly 110 has a jacket 112 housing a pad assembly 114, a personalized prescription pad 116 and an information booklet 118.

Jacket 112 has front panel-like covers 120 and 122, rear panel-like cover 124, spines 126 and 128 and folds 130. Spine 126 is disposed between front cover 120 and rear cover 124, and spine 128 is disposed between front cover 122 and rear cover 124. A fold 130 is formed between each of front cover 120 and spine 126, spine 126 and rear cover 124, rear cover 124 and spine 128, and spine 128 and front cover 122.

Jacket 112 includes an inner layer 132 and an outer layer 134 secured together at least at their outer edges. Suitably layers 132 and 134 may be of a synthetic fabric-like material, for example, plastic, heat welded or adhered together at their adjacent outer edges.

A pocket 136 is formed between inner layer 132 and 134 on an inside face of the rear cover 124 which underlies front cover 120 in a closed configuration of jacket 112; a pocket 138 is formed between inner layer 132 and outer layer 134 on an inside face of rear cover 124 which underlies front cover 122 in such closed configuration; and a pocket 140 is formed between inner layer 132 and outer layer 134 on the inside face of front cover 122.

With particular reference to FIGS. 8, 9, 10 and 11, pad assembly 114 includes a hinge 142, an outer cover panel 144, an inner cover panel 146 and divider panels 148, 150, 152, 154, 156 and 158.

Hinge 142 includes a spine 160 having an outer free edge 162 and an inner edge 164. A plurality of spaced apart fingers 166 extends from inner edge 164 in curved fashion, the outer ends of fingers 166 being flexingly engaged by spine 160.

The outer cover panel 144, the inner cover panel 146 and divider panels 148, 150, 152, 154, 156 and 158 each have a plurality of spaced apart slots 168 through which fingers 166 pass, whereby the panels 144 to 158 are flippably, hingedly mounted on hinge 142.

Outer cover panel 144 includes a tab 170 and divider panels 148, 150, 152, 154 and 156, each have respective tabs 172, 174, 176, 178 and 180.

Each of panels 144 to 158 has a transparent front wall 182 and a transparent rear wall 184 sealed together at a peripheral edge 186. Divider panels 148, 150, 152, 154, 156 and 158 are additionally sealed along a line 187 spaced inwardly of an inner edge 185 of peripheral edge 186, a mounting strip 188 being defined between line 187 and edge 185 in which are formed the slots 168.

A pocket 190 is formed between the front wall 182 and rear wall 184, and adjacent the mounting strip 188 of each of the divider panels 148, 150, 152, 154, 156 and 158.

Pads 210, 310, 410, 510, 610 and 710 are supported in the pocket 190 of respective divider panels 148, 150, 152, 154, 156 and 158.

Each of pads 210, 310, 410, 510, 610 and 710 comprise a stack 20 of units 22 as described with reference to FIGS. 1 to 5, each of the pads 210, 310, 410, 510, 610 and 710 being for a different definite pharmaceutical product. In each case support card 16 of a pad is received in a pocket 190 to mount a pad, for example, pad 210, in the appropriate panel, i.e., panel 148 in the case of pad 210.

The preprinted prescription leaves 12 of a pad, for example, pad 210, are all identical and different from the preprinted prescription leaves 12 of the other pads, for example, pad 310.

An index 212 is disposed between walls 182 and 184 of outer cover panel 144 and an indicium 214 is displayed by each of tabs 170, 172, 174, 176, 178 and 180.

Pad 116 comprises a plurality of regular prescription forms 216.

In a particular embodiment as shown, the indicia 214 are the integers 1, 2, 3, 4, 5 and 6; the indicium 1 is displayed in tab 170 of outer cover panel 144, the indicium 2 is displayed in tab 172, the indicium 3 in tab 174, the indicium 4 in tab 176, the indicium 5 in tab 178 and the indicium 6 in tab 180. As shown in FIG. 7, the indicium 214 are all displayed and visible in the open configuration when front cover 120 is raised.

Each indicium 214 appears with identification of the drug category in the index 212. Thus in the particular example the indicia 214 are identified with categories as follows:

| Indicium | Drug Category |
|---|---|
| 1 | Antiarthritics |
| 2 | Antihypertensives |
| 3 | Antiulcers |
| 4 | Bronchodilators |
| 5 | Calcium Antagonists |
| 6 | Diuretics |

Pad 210 is supported by divider panel 148 and is thus disposed immediately below outer cover panel 144 of which tab 170 displays the indicium 1 which thus relates to pad 210. Index 212 indicates that the indicium 1 is for an antiarthritic. Thus each of the prescription leaves 12 of the pad 210 has a preprinted prescription 40 for a sample of a particular brand name 44 antiarthritic.

Thus if the physician determines that a patient needs an antiarthritic, he refers to index 212 and determines that antiarthritics are identified by the integer 1 of the indicia 214.

Flipping or lifting tab 170 displaying the integer 1 exposes or displays the pad 210. This represents one of the open configurations of the pad assembly 114.

The physician then proceeds as described with reference to FIGS. 1 to 5.

The binder assembly 110 and in particular pad assembly 114 ensure that the pharmaceutical company only incurs the costs and expense associated with free samples when a free sample has actually been dispensed to a patient by a pharmacist and avoids the additional expense associated with production of special small dosage sample packages and their delivery to physicians.

A binder assembly 110 can readily be provided to physicians in areas which might not normally be visited by sales representatives of pharmaceutical companies who might be responsible for delivering packages of samples; similarly replacement pads 210 etc. can be readily dispatched to physicians.

The booklet 118 suitably contains prescribing information with respect to the specific brand pharmaceutical of each of the categories of index 212.

It will be understood that the pad assemblies 114 can be customized according to the needs of a particular physician with respect to the therapeutic categories, and also with respect to the particular drug of each category. Thus the specific antihypertensive of a pad 210 of one binder assembly 110 is not necessarily the same as the specific antihypertensive of a pad 210 of another binder assembly 110.

Furthermore, the invention is not restricted to the particular six therapeutic categories illustrated in index 212, and other drug categories can be included and there may be more or less than 6 categories; as desired. When the number of drug categories is n, where n is a whole number integer greater than 1, there will be n divider panels, similar to panels 148 to 158, n tabs similar to tabs 170 to 180, n indicia 214, n pads similar to pad 210 to 710 and n open configurations in which one of the n pads is displayed and accessible to the physician; including the outer and inner cover panels 144 and 146 there are n+2 panels.

It will be understood that the signing zone 56 will vary based on the state of the use in the U.S.A. in so far as the different states have different regulations.

Figure 9:
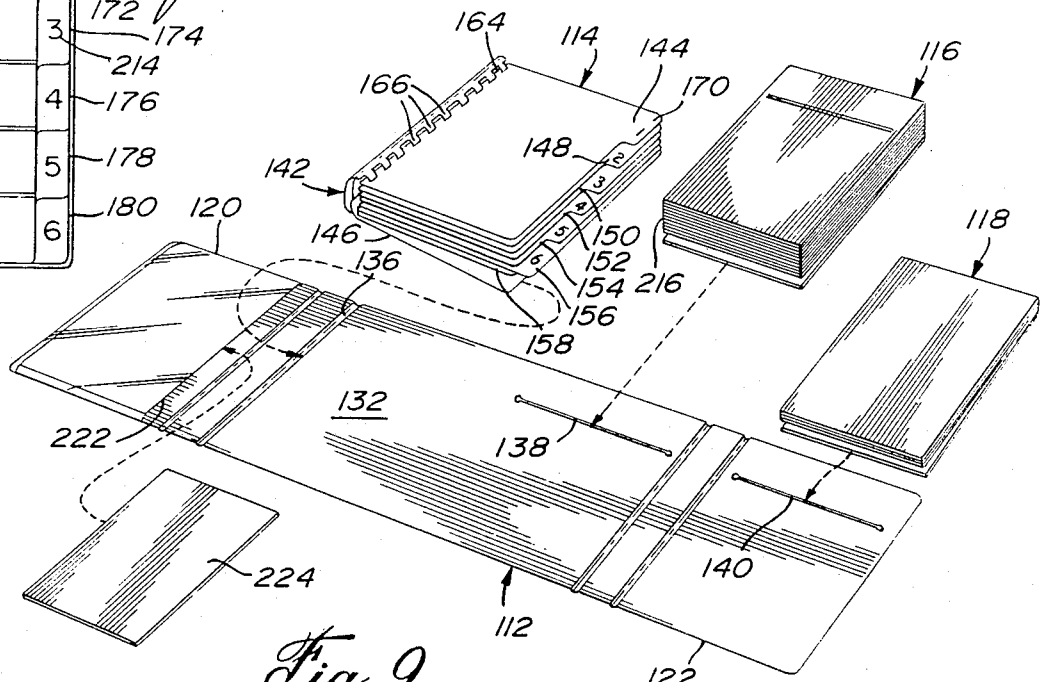
FIG. 9 is a perspective view of the assembly of FIG. 6 in an exploded configuration.
Figure 8:
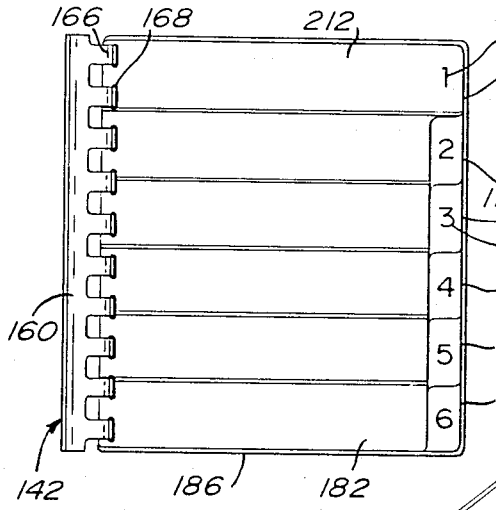
FIG. 8 is a front view of a pad assembly of the invention removed from the binder assembly of FIG. 6 in a closed configuration.
Figure 10:
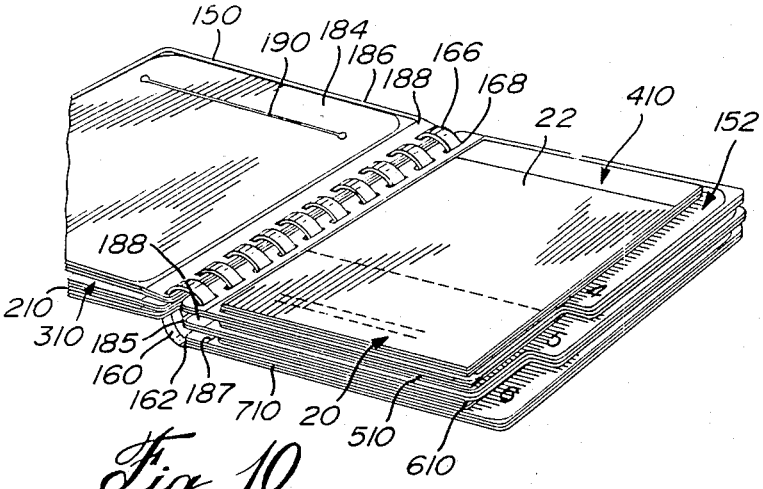
FIG. 10 is a perspective view of the assembly of FIG. 8 in one of the plurality of open configurations.
Figure 11:
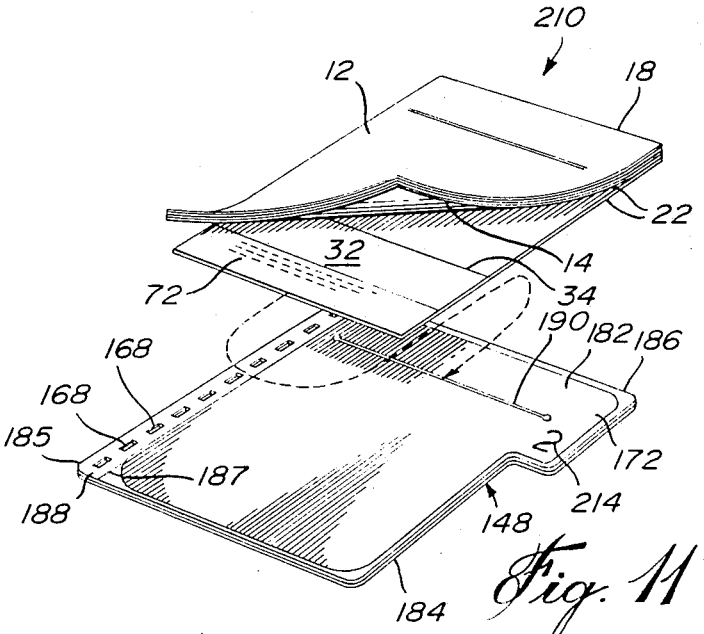
FIG. 11 is an exploded view of one pad of the assembly of FIG. 8 with its supporting panel.

As particularly shown in FIGS. 7 and 9, front cover 120 may include a transparent pocket 222 which may be employed to house product data or advertising 224.

This invention may be embodied in other forms or carried out in other ways without departing from the spirit or essential characteristics thereof. The present embodiments with reference to the drawings are therefore to be considered as in all respect illustrative and not restrictive, the scope of the invention being indicated by the appended claims, and all changes which come within the meaning and range of equivalency are intended to be embraced therein.

I claim:

1. A prescription pad comprising:

at least first and second associated sheet means, said first sheet means having a prescription portion including a first zone bearing a preprinted prescription for a distant pharmaceutical product, a second zone for entry of information identifying a patient for whom the distinct pharmaceutical product is being prescribed and a third zone for entry of a signature of a prescribing medical practitioner, said second sheet means bearing on a first face thereof, a preprinted cheque in favour of a dispensing pharmacist, said cheque having a defined monetary reimbursement value, and said second sheet means bearing on a second face opposite to said first face thereof, an endorsing zone preprinted with a dispensing acknowledgement legend related to said preprinted prescription, said endorsing zone having an entry portion for entry of an endorsing signature of the dispensing pharmacist.

2. A prescription pad according to claim 1, wherein said first sheet means further includes a preprinted medical practitioner identification zone personalizing said pad by reference to the medical practitioner identification.

3. A prescription pad according to claim 2, at least said second sheet means bearing on the first face thereof, an identification code corresponding to the medical practitioner identification on said first sheet means.

4. A prescription pad according to claim 3, wherein said identification code on said second sheet means is computer readable.

5. A prescription pad according to claim 4, wherein said first and second sheet means comprise distinct first and second sheet members.

6. A prescription pad according to claim 5, comprising an identical plurality of each of said first and second sheet members; said identical plurality forming a stack of units, each unit comprising a single first sheet member and a single second sheet member, said units being disposed in said stack such that the first and second sheet members alternate.

7. A prescription pad according to claim 6, wherein the first and second sheet members of a unit are hingedly secured together along a pair of opposed, adjacent edges, to form a hinged end, said first and second sheet members of a unit being readily removable from each other.

8. A prescription pad according to claim 7, wherein said units of said stack are hingedly secured together at their opposed, adjacent hinged ends, each unit being individually readily removable from said stack as an integral unit.

9. A prescription pad according to claim 8, in which said sheet members are paper sheets and further including a relatively stiff support card member, said units being hingedly secured on said support card member.

10. A prescription pad according to claim 8, wherein said first sheet member includes a preprinted refill zone having a refill data entry portion for entry of refill data by the prescribing medical practitioner.

11. A prescription pad according to claim 10, wherein said first sheet member includes a detachable stub portion for retention by the patient, said stub portion bearing information relating both to the preprinted prescription of the prescription portion of the first sheet member and the preprinted cheque of said second sheet member.

12. A prescription pad according to claim 11, wherein said third zone portion further includes a preprinted product instruction zone having instruction entry portions whereby the prescribing medical practitioner may indicate whether or not substitution is permitted.

13. A prescription pad according to claim 12, wherein said second sheet member of each unit is below said first sheet member and projects beyond said first sheet member remote from said hinged end.

14. A prescription pad assembly for prescription pharmaceuticals comprising:

a plurality of prescription pads, each of said prescription pads being a pad as defined in claim 1, each prescription pad of said plurality bearing a preprinted prescription for a distinct pharmaceutical product different from a preprinted prescription of other prescription pads of said plurality, a plurality of identification means, each identification means relating to a said distinct pharmaceutical product of a said preprinted prescription, and holder means uniting said plurality of prescription pads and said plurality of identification means as a unitary assembly with each of said identification means being in a predetermined association with a prescription pad of the said plurality of prescription pads for the same distinct pharmaceutical product.

15. An assembly according to claim 14, further including index means related to said identification means of the said plurality, said indexing means being part of said unitary assembly.

16. A binder assembly comprising:

a binder jacket. a prescription pad assembly as defined in claim 14, supported in said jacket, and a pad of prescription forms supported in said jacket.

17. A binder assembly according to claim 16, wherein said binder jacket is adjustable from a closed configuration in which said prescription pad assembly and said pad of prescription forms are substantially concealed, to an open configuration in which said prescription pad assembly and said pad of prescription forms are displayed, said prescription pad assembly and said pad of prescription forms being supported in said jacket so as to be in adjacent relationship in the open configuration.

18. A binder assembly according to claim 17, wherein said prescription pad assembly and said pad of prescription forms are in side-by-side relationship in the open configuration.

19. A prescription pad assembly for prescription pharmaceuticals comprising:

a plurality of prescription pads, each of said prescription pads being a prescription pad as defined in claim 1, each pad of the said plurality of prescription pads bearing a said preprinted prescription for a distinct pharmaceutical product different from the preprinted prescriptions of other prescription pads of the said plurality of prescription pads, a plurality of identification means, each identification means relating to a said distinct pharmaceutical product, indexing means related to said plurality of identification means, and holder means mounting said plurality of prescription pads, said plurality of identification means and said indexing means, as a unitary assembly with each identification means in a predetermined association with a prescription pad of said plurality of prescription pads.

20. An assembly according to claim 19, wherein said unitary assembly has a closed configuration in which said indexing means and said plurality of identification means are all displayed and said plurality of prescription pads is concealed, and a plurality of open configurations, one of said prescription pads of the said plurality of prescription pads being displayed in each of said open configurations, the pluralities of prescription pads, identification means and open configurations having identical numerical values.

21. A unitary prescription pad assembly for prescription pharmaceuticals comprising:

a hinge member, a plurality of panel members comprising an outer cover panel, an inner cover panel and a plurality of divider panels, said panel members being hingedly mounted on said hinge member and disposed in an opposed facing relationship in a closed configuration, with said divider panels sandwiched between said outer and inner cover panels, said panel members being flippably movable about said hinge member from the closed configuration to a plurality of open configurations, a plurality of identification means, each identification means of the said plurality being associated with a panel member of said plurality of panel members selected from said outer cover panel and said divider panels, said plurality of identification means being disposed so as to be simultaneously displayed in the closed configuration.

a plurality of prescription pads, each of said prescription pads being a prescription pad as defined in claim 1, each prescription pad of said plurality of prescription pads having a said preprinted prescription for a distinct pharmaceutical product different from the preprinted prescriptions of other prescription pads of the said plurality of prescription pads, each prescription pad of the said plurality of prescription pads being supported by a said divider panel such that the prescription for a distinct pharmaceutical product on the said prescription portions of a prescription pad of the said plurality of prescription pads supported by the said divider panel, interrelates with the identification means associated with an adjacent panel member disposed outwardly of the said divider panel, each identification means relating to a said distinct pharmaceutical product of the preprinted prescription of a said prescription pad, indexing means associated with said outer cover panel related to said identification means of said plurality of identification means and displayed simultaneously with said plurality of identification means in the closed configuration, said indexing means identifying a distinct therapeutic category of each prescription pad of said plurality of prescription pads and interrelating each said category with the identification means associated with the said adjacent panel member disposed outwardly of the supporting divider panel of such prescription pad.

22. An assembly according to claim 21, wherein the said plurality of identification means, open configurations and prescription pads have the same numerical value n and said plurality of panel members has the numerical value n+2, wherein n is a whole number integer greater than 1.

23. A binder assembly comprising:

a binder jacket having a back panel and first and second front panels connected to opposed ends of said back panel, said front panels each having a free outer edge and extending toward each other in opposed spaced apart relationship with said back panel in a closed configuration of said jacket in which said free outer edges are adjacent, said front panels being independently foldable from the closed configuration to lie in a plane containing said rear panel, first mounting means in said back panel, said first mounting means being disposed beneath said first front panel in the closed configuration of said jacket, a unitary prescription pad assembly as defined in claim 21, mounted on said back panel by said first mounting means such that said outer cover panel of said pad assembly is adjacent and beneath said first front panel in the closed configuration of said jacket.

24. An assembly according to claim 23, wherein said second mounting means is in said back panel disposed beneath said second front panel in the closed configuration of said jacket.

25. A prescription pad according to claim 1, wherein said preprinted prescription is for a starter dosage of the distinct pharmaceutical product, and said defined monetary reimbursement value encompasses a value of the preprinted prescription and a pharmacy dispensing fee.

26. A prescription pad according to claim 1, wherein said defined monetary reimbursement value represents a discount of a cost to the patient of the preprinted prescription.

* * * * *